United States Patent [19]

Willcox

[11] Patent Number: 4,466,753

[45] Date of Patent: Aug. 21, 1984

[54] CARRIAGE GUIDING SYSTEM AND FRAME FOR A PRINTER

[76] Inventor: Frederick P. Willcox, 565 Oenoke Ridge, New Canaan, Conn. 06840

[21] Appl. No.: 422,922

[22] Filed: Sep. 24, 1982

[51] Int. Cl.[3] ..... B41J 19/00

[52] U.S. Cl. ..... 400/354; 400/320

[58] Field of Search ..... 308/3 A, 3 R; 400/320, 400/328, 352, 354, 354.1, 354.2, 354.3, 58

[56] References Cited

U.S. PATENT DOCUMENTS

| | | | |
|---|---|---|---|
| 1,832,622 | 11/1931 | Dean | 400/354.1 |
| 2,367,957 | 1/1945 | Metcalfe | 308/3 A |
| 2,864,269 | 12/1958 | Moltin | 308/3 R |
| 3,461,235 | 8/1969 | Willcox et al. | 178/25 |
| 3,469,124 | 9/1969 | Willcox | 310/49 |
| 3,534,847 | 10/1970 | Willcox | 197/18 |
| 3,650,576 | 3/1972 | Hughes | 308/3 A |
| 3,666,071 | 5/1972 | Purr | 197/60 |
| 3,674,323 | 7/1972 | Zankl et al. | 308/3 A |
| 3,731,778 | 5/1973 | Willcox | 197/16 |
| 3,867,676 | 2/1975 | Chai et al. | 318/135 |
| 3,892,303 | 7/1975 | Willcox | 197/18 |
| 4,020,767 | 5/1977 | Hardy | 308/3 R |
| 4,044,881 | 8/1977 | Chai et al. | 197/82 |
| 4,047,607 | 9/1977 | Willcox | 197/151 |
| 4,068,906 | 1/1978 | Dur et al. | 308/3 A |
| 4,149,808 | 4/1979 | Matthias et al. | 400/144.2 |
| 4,198,582 | 4/1980 | Matthias et al. | 310/12 |
| 4,208,142 | 6/1980 | Chu | 400/320 |
| 4,257,282 | 3/1981 | Wilczewski et al. | 400/320 |
| 4,303,347 | 12/1981 | Siegenthaler | 400/320 |
| 4,313,283 | 2/1982 | Smith | 308/3 A |

FOREIGN PATENT DOCUMENTS

| | | | |
|---|---|---|---|
| 30271 | 6/1981 | European Pat. Off. | 400/354 |
| 2500418 | 9/1975 | Fed. Rep. of Germany | 400/58 |
| 2941969 | 4/1981 | Fed. Rep. of Germany | 400/354 |

OTHER PUBLICATIONS

Cummings, et al., "Cast Cantilever Manipulator Frame" IBM Technical Disclosure Bulletin vol. 25, No. 5 pp. 2675–2676 10/82.

Ex. 1–Models and Other Items to Which 3M is Given Title Under Article V.

Ex. 2–Photos of Model 1–W Printer.

Ex. 3–Photos of Model 2–W Printer.

Ex. 4–3 Sheets of Diagrams.

*Primary Examiner*—William Pieprz

*Attorney, Agent, or Firm*—William D. Hall

[57] ABSTRACT

A printer employing a movable print carriage is fitted with a single rigid bar-like carriage support structure having three very narrow, low friction, plain guideways, either grooves or rails, kinematically arranged for extremely accurate guiding of the printing carriage as it moves along the writing line. The print carriage is fitted with kinematically arranged mechanically reciprocal guides for engaging the guideway grooves or rails. The carriage support structure is made sufficiently rigid and massive to also serve as the printer frame for supporting the platen and other printer parts and elements. The location of the three guideways, primary feed roller bearing supports, platen supports, and platen adjustment rod bearings are such that all can be machined in one set-up in a multiple spindle machine tool so as to achieve exact parallelism of all the elements requiring precise alignment.

16 Claims, 14 Drawing Figures

10
42
46
24
25
44
58
60
54
52
12
62
64
68
26
28
30
48
50
56
38
36
25
39
32
34
40
74
70
76
72
16
14
22
20
18
80
78
66

10
37
12
39
90
56
60
8
70
94
66
82
76
92
96
84
74
72
98
77
80
80
16
18
81
83
86
78
100
22
14
86
20
102

FIG. 3
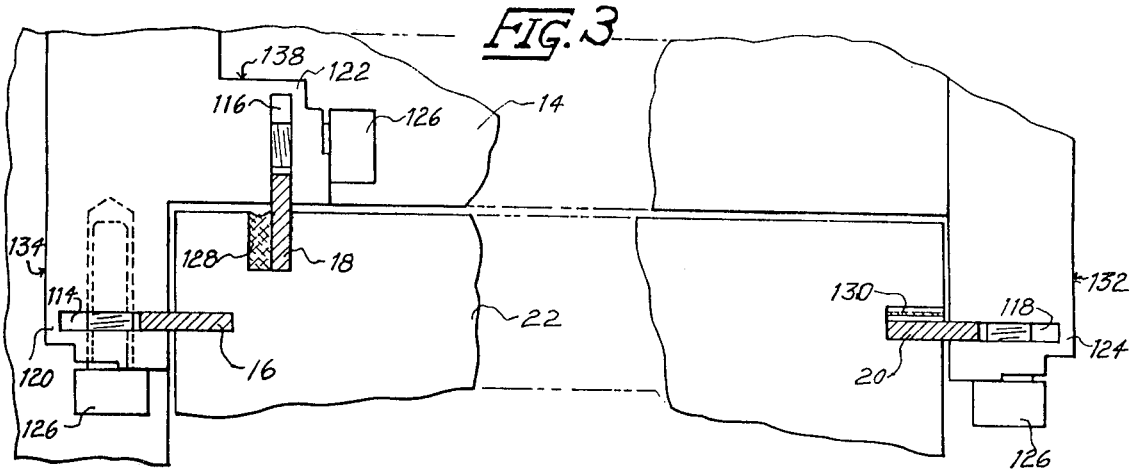
FIG. 5
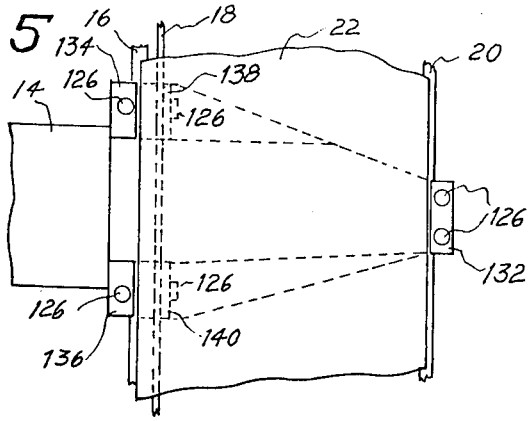
FIG. 4
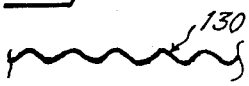
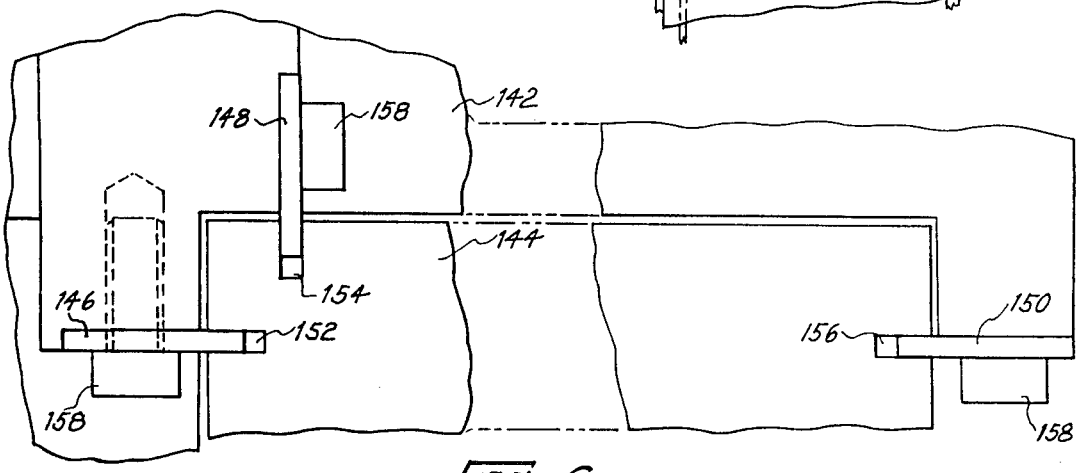
FIG. 6
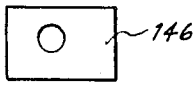
FIG. 7a
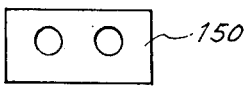
FIG. 7b

CARRIAGE GUIDING SYSTEM AND FRAME FOR A PRINTER

SUMMARY OF THE INVENTION

This invention solves print carriage guideway problems of prior constructions involving straightness, flexibility, friction, and exact parallelism to the platen as well as having certain cost advantages. A rigid and relatively massive bar having three kinematically arranged guideways is employed for supporting the print carriage, and is also employed as the machine frame to support the platen bar and paper feeding and guiding assemblies.

The guideways of this rigid carriage support bar are formed by machining three narrow and relatively shallow grooves along three sides of the bar in one set-up on an appropriate machine tool to achieve exact parallelism and straightness. The three grooves may be either used directly as guideways being engaged by sliding hard metal shoes fitted to the print carriage, or may have narrow hard steel rails retained in the grooves which are engaged by matching kinematically disposed grooves machined in the print carriage. If rails are used, they are retained in the support bar by one of two novel means; first, by using a soft metal such as tin pressed into the groove alongside of the rail, or; second, by initially retaining the rail with a wavy ribbon of metal pressed into the groove with the rail and filling in the spaces on each side of the wavy ribbon with an appropriate cement for permant retention of the rail.

This same massive carriage support bar may be used as the machine frame when fitted with integral ribs for supporting the platen bar, part of the paper guides, and the primary feed roller. Properly designed, the platen support and adjustment eccentric bearing areas, and the bearing supports for the primary feed roller can all be machined on the same set-up as the guideway grooves for precise parallelism. In the preferred construction of this integral carriage support bar and machine frame, the bar is located below the platen bar with the carriage cantilevered forward and upward to a position in front of the platen bar.

Whether or not the carriage support bar is in front of or below the platen bar, assuming a flat platen is used, both the support bar and the platen bar are desirably dimensioned so that the cumulative deflection during imprinting, when the print carriage is in mid-position, does not exceed 0.001 inch or 0.025 mm., and the parallelism of the carriage line of travel does not deviate more than plus or minus one-fifth that amount in any carriage position along the support bar.

If rails are used as guideways, they should be not less than 0.025 inches (0.6 mm) thick nor project more than two to two and one-half times the thickness from the bar for good rigidity. If grooves are used as guideways the width of the grooves should not be less than 0.032 inches (0.8 mm) and the depth of sliding shoe engagement should not exceed 0.050 inches (1.27 mm). If these minimum and maximum dimensions are adhered to, for a 12 to 15 inch (30.5 to 38.1 mm) platen, excellent fit and low friction properties can be maintained, sufficiently so that a 4 or 5 ounce (113.4 or 141.8 gram) print carriage will begin to slide of its own weight if the support bar is tilted up no more than 25° to 30°, assuming of course, that the guideways are properly lubricated.

BRIEF DESCRIPTION OF THE DRAWINGS

FIG. 3 is an enlarged partial left end view of the print carriage and the carriage support bar showing guideway details using guide rails.

FIG. 4 is an enlarged partial edge view of a guide rail retainer.

FIG. 5 is a schematic bottom view of the carriage showing the relative locations of the five guiding areas on the carriage FIG. 6 is an enlarged partial left end view of the carriage and support bar showing guideway details using guide grooves.

FIG. 7 shows the two types of guide shoes used in the FIG. 6 construction.

DETAILED DESCRIPTION

The carriage guiding system and frame of this invention can be applied to many kinds of printers or typewriters. The system and construction shown and described herein is applied to a printer which employs individual type chips which are stored in a drum which is rotated for chip selection to a position where the chip is pushed out of the drum into an impressing member which carries the chip to the imprinting position. Such a type font structure is shown in my U.S. Pat. Nos.

3,731,778 May 8, 1973, "printer Having Individual Character Chips," and 3,892,303 July 1, 1975, "Type Font Changing Mechanism and Controls."

Another kind of type font structure which can ideally be used with this invention is shown in my U.S. Pat. No.

3,534,847 Oct. 20, 1970, "High Speed Teleprinter."

The foregoing three patents are incorporated herein by reference and may be referred to for printer details not shown or described herein.

Figure 1:
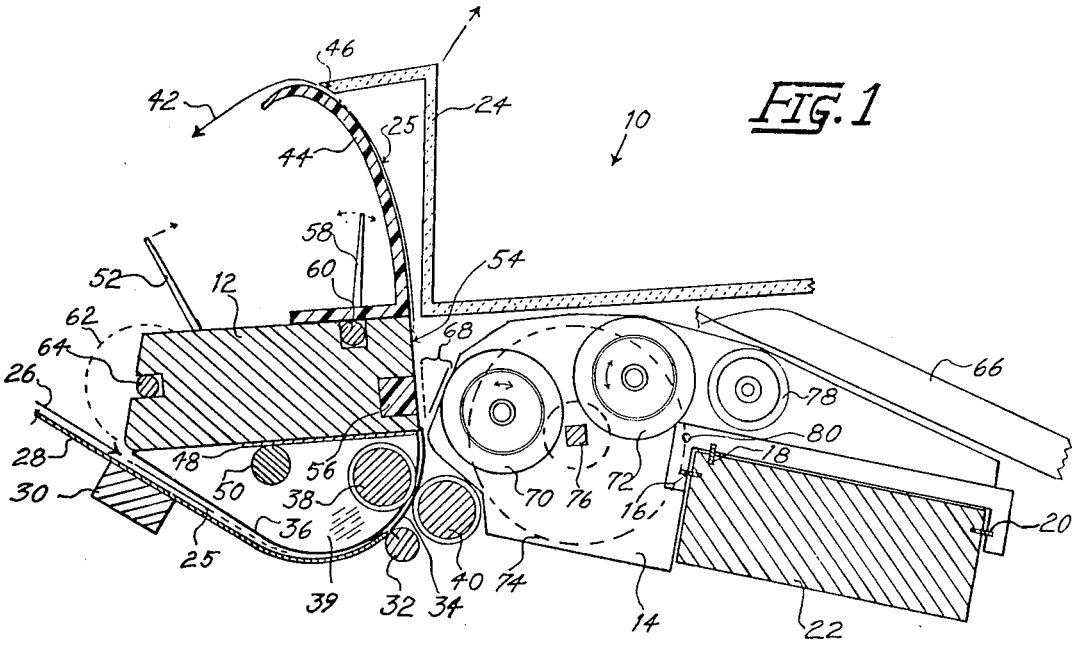
FIG. 1 shows a partial cross-section elevation, taken from the left side, of a printer incorporating a rigid flat platen bar and a single rigid carriage support bar fitted with three narrow kinematically arranged guideways.

FIG. 1 shows the essential elements of a printer, generally designated by the numeral 10, which is designed to print with individual character type chips as further shown and described in the first two of the above referenced patents. Printer 10 is fitted with a massive platen bar 12 for supporting record material along a writing line. A print carriage 14 is slidably supported on three narrow guide rails; front rail 16, top rail 18, and back rail 20, which are fixed in a massive carriage support bar 22. A transparent printing area cover 24 provides part of the radiated imprinting noise reduction system of the printer and also serves as part of the paper guiding system. This cover 24 is hinged, by means not shown, to either part of the printer case or to the upper edge of the keyboard support, and may be swung generally upward and forward away from the printing area for access thereto.

The input path for record material 25 is indicated by arrow 26 and is directed to the writing line along the face of platen bar 12 by inner and outer paper guides. Outer paper guide 28 is supported by fixed transverse bars 30 and 32. A thin springy outer front paper guide 34 is also supported by transverse bar 34 and serves as a flexible extension of guide 28. An inner paper guide 36 is retained on two lateral ribs 37 and 39, the right rib 39 shown in this figure, which are attached to the bottom of platen bar 12, and completes the paper or record material infeed channel and directs the record material between the spring loaded inner feed roller 38 and primary feed roller 40 and thence to the printing area.

The exit path of record material 25 is indicated by arrow 42. As the record material 25 leaves the writing line it is guided along the front surface of specially curved exit guide 44 and may be loosely confined thereto by the upper edge 46 of cover 24. Alignment of the top edge of an inserted piece of record material is obtained by a paper alignment guide 48 which is temporarily projected into the infed record material path just below the writing line as it exits from between inner guide 36 and front guide 34. Alignment guide 48, which is slidably supported in grooves in lateral ribs 37 and 39, cooperates with projections on shaft 50 which is part of the lifting mechanism, not shown, which separates the feed rollers 38 and 40 for record material insertion against alignment guide 48. Shaft 50 is connected to lever 52 which is rotated clockwise by the operator before record material insertion and released after record material alignment against guide 48. The releasing action or counterclockwise rotation of shaft 50 retracts alignment guide 48 and effects re-engagement of the feed rollers 38 and 40.

Platen bar 12 has a generally flat face 54 in the printing area for backing up and supporting the record material 25 along the writing line. A convexly curved face may also be used but this requires that the type faces be conformally curved. Platen bar 12 is adjusted for the thickness of the record material 25 by lever 58 attached to shaft 60 which has eccentric bushings on each end which engage respective slots or holes in the printer frame structure which supports the ends of platen bar 12. Further, platen bar 12 may be tilted for top-to-bottom impression depth control by means of a possible knob 62, shown dotted line, attached to transverse shaft 64 which is also fitted with eccentric bushings on each end.

A ribbon is generally indicated at 66. In the printing area between the carriage 14 and the platen face 54, the ribbon can assume one of two positions, solid line and dotted line as collectively indicated at 68. The solid line position is assumed when at rest or during transport. During imprinting, the print mechanism pushes the ribbon to the approximate dotted line position, parallel to the platen face 54.

The print carriage 14 has a mechanism for making a line of imprints with individual type-face-bearing chips as shown in the referenced U.S. Pat. No. 3,731,778 and may have a printing mechanism similar to that shown schematically in that reference, or may have a squeeze printing mechanism, details not shown here, but shown in my co-pending U.S. patent application Ser. No. 422,923 filed Sept. 24, 1982 and titled "Squeeze Printing Mechanism." The paper feeding and guiding system shown herein is covered in greater detail in my U.S. patent application Ser. No. 422,935 filed Sept. 24, 1982 and titled "Paper Feeding and Guiding System."

The squeeze printing mechanism of print carriage 14 is operated by a primary actuator 70 and a secondary actuator 72, both being of the electromagnetic type as shown in my U.S. Pat. No. 3,469,124 Sept. 23, 1969 "Multistage Impulse Operated Rotary Stepping Motor." Carriage 14 laterally retains a type font drum 74 which is slidably supported on drive shaft 76. A type font comprising ninety-six type chips, each having a type face, are accessibly stored in drum 74. The font drum 74 is rotated by a stepping motor 77 to selectively position a desired type chip for retrieval and printing therewith as shown in the referenced U.S. Pat. Nos. 3,731,778 and 3,892,303. In printer 10 a selected type chip is pushed out from its storage position in drum 74 by means of a solenoid 78 which linearly acts on a narrow blade which enters a slot in the back of drum 74 to act upon the selected type chip.

In FIG. 1, the printer 10 is tilted back about 5° for good lighting of the writing area, and also to cause the record material 25 to naturally lay against exit guide 44.

Figure 2:
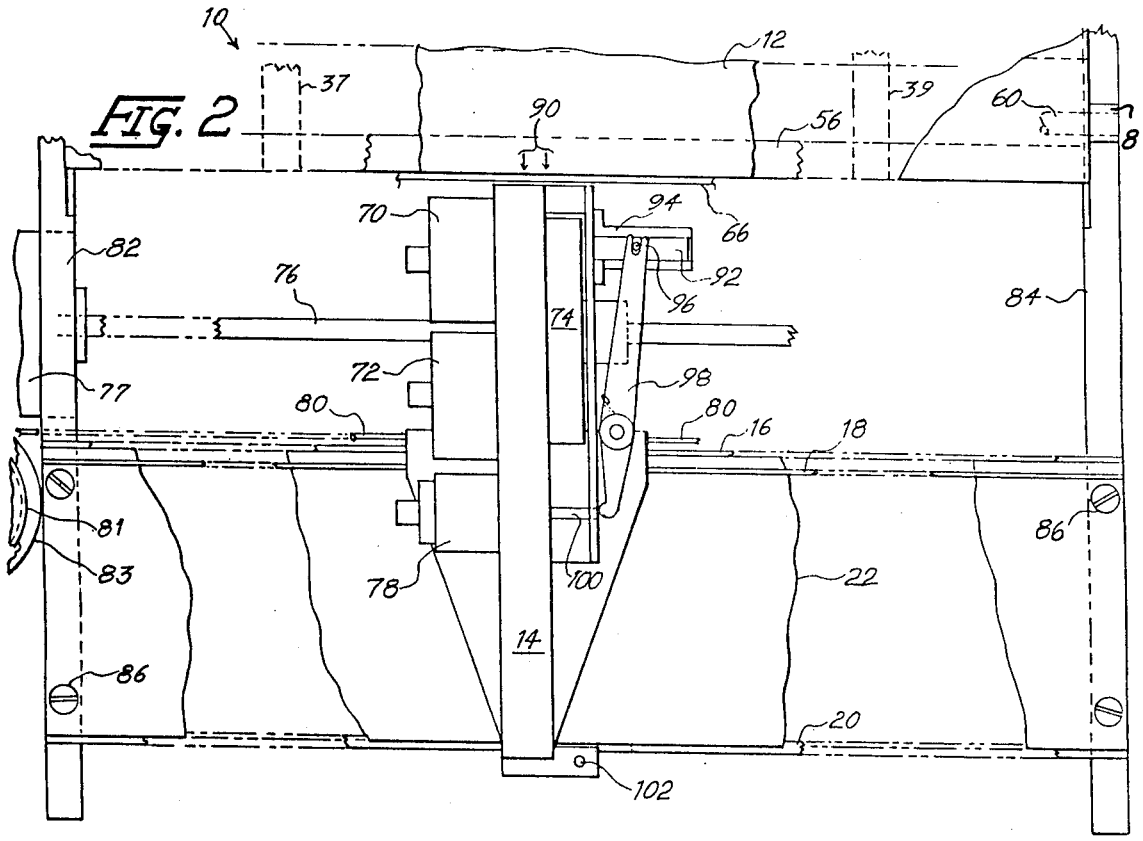
FIG. 2 is a partially cutaway top view of the printer with the platen bar rotated forward 15° so that its face is normal to the plane of the print carriage support bar for clarity of illustration.

In FIG. 2, the general planform of printer 10 can be seen. The carriage support bar 22 may be attached to the left and right side plates 82 and 84, respectively, by screws 86, or preferably side plates 82 and 84 would be integral with the support bar 22 as a casting and thus comprise the machine frame. Side plates 82 and 84 are appropriately machined and fitted to retain platen bar 12 and to provide bearing surfaces for the adjustment eccentrics on the ends of shafts 60 and 64. One such eccentric is indicated at 88 and is on the end of shaft 60, which also has a similar eccentric on the other end.

The approximate instant print area on the platen bar 12 is defined by the twin boundry arrows 90. Type chips are removed from the font drum 74 and injected into the impressing member of the print mechanism by blade 92 which slides in support 94. Blade 92 has a projecting pin 96 which is engaged by lever 98 which, in turn, is moved counter-clockwise to inject a chip by means of solenoid 78 acting through push rod 100 and is restored by a spring.

The back end of carriage 14 has a hole 102 in the guide extension for engaging an articulated ribbon guide member such as that shown in My. U.S. Pat. No. 4,047,607 Sept. 13, 1977, "Articulated Ribbon-Guiding Structure." The on-carriage ribbon guides can be positioned in a manner similar to those shown schematically in that patent. If ribbon 66 is brought up and over carriage 14 as shown in FIG. 1, the on-carriage ribbon guides are made of partially twisted metal strips to effect a vertical bend in the ribbon path as is well-known in the art.

Referring now to FIG. 3, the left side elevation of print carriage 14 is partially shown. A carriage support bar 22 is fitted with three guide rails: front rail 16, top rail 18, and back rail 20. The term back as used herein refers to the back of the print carriage as opposed to the front which faces the printing area. The rails 16, 18, and 20 are precisely located in exact parallelism in a kinematic arrangement as shown to resist rotation of carriage 14 in any plane. The carriage 14 has respective front, top, and back grooves 114, 116, and 118 which are closely fitted to slide on the respective guide rails 16, 18, and 20.

These grooves 114, 116, and 118 can be precisely cut into the carriage 14 only deep enough to clear the respective outside edges of rails 16, 18, and 20. To do so is practical but requires extremely close control of width to get the minimum sliding clearance. To solve this problem the grooved portions of carriage 14 are cut deeply into the carriage leaving flexure hinge areas 120, 122, and 124 for example. Small fine pitch cap screws 126, are used to "close" the grooves to secure the running clearance desired and then secured in place by a suitable plastic adhesive.

The guide rails may be secured in the carriage support bar 14 in several different ways. Three possible constructions are illustrated in FIG. 3. Front rail 16, which is desirably made of a hard material such as clock spring steel, is pressed into a precision width groove. Such construction has been used experimentally but a precise fit is most difficult to obtain. The second, and preferred form of rail retention is shown at top rail 18. A groove which is about twice as wide as the rail is thick is machined into carriage support bar 22. Then the rail, in this case rail 18, is retained by a soft metal 128, such as tin which is pressed firmly in place. The soft metal could also be type metal which expands slightly after cooling. This assuming that it is melted and poured into the groove.

The third alternate form of guide rail retention is shown with back rail 20. Here, a wavy strip of metal 130, shown edgewise in FIG. 4, is pressed into place along side back rail 20 to firmly retain it against one side of the groove in bar 22. The space around the wavy strip of metal 130 can the be filled with some appropriate type of cement or filler. The wave length of the corrugations in strip 130 is mostly dependent on the thickness of rail 20 and the amount of force required to keep the rail tightly against the groove sidewall.

FIG. 5 shows the carriage 14 fitted with a single back guide 132 having two adjustment screws 126 for adjusting the sliding fit of groove 118. Front rail 16 is engaged by two carriage guides 134 and 136 spaced some distance apart such as 1.5 inches (38 mm) in the proportions shown. Inasmuch as FIG. 5 is bottom view, the two top carriage guides 138 and 140 which engage rail 18 are shown in dotted line. These guides 132, 134, and 138 are also identified in FIG. 3 by the same numerals. As also shown, guides 134, 136, 138, and 140 each have a single cap screw 126 for adjusting the fit of the respective grooves on the rails 16 and 18.

Referring to FIG. 6, another form for the print carriage-carriage support bar combination is shown. A print carriage 142 is slidably supported on the carriage support bar 144 by having hard metal shoes 146, 148, and 150 fastened thereto which engage respective front, top and back grooves 152, 154, and 156. The planform of the metal shoe 146, or 148, is shown in FIG. *7a*, and that of shoe 150 in FIG. *7b*. The front and top shoes 146 and 148 are retained by a single cap screw 158 and the back shoe 150, which is made for longer engagement of groove 156, is retained by two cap screws 158. Two front shoes 146, and two top shoes 148 are used and spaced the same as the guides shown in FIG. 5. The use of shoes sliding in grooves requires a very excellent fit to prevent carriage sloppiness or wobble. This disadvantage, the cost of a high degree of accuracy, is somewhat offset by eliminating the guide rails as previously described and in particular, any problem arising from differential expansion or contraction between steel rails and an aluminum alloy support bar. The five shoes on carriage 142 are retained by cap screws 158. While removable shoes 146, 148, and 150 are shown, they could each be short rails fixed in the carriage body.

Figure 8:
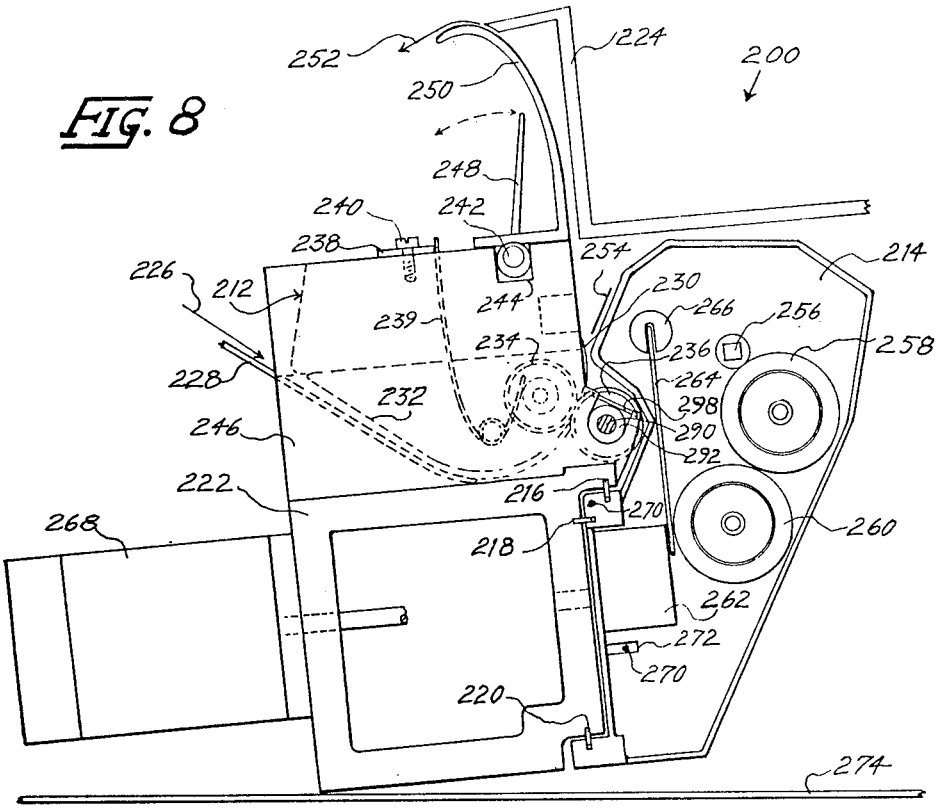
FIG. 8 is a left end elevation of a printer with the print carriage support bar located below the platen bar for supporting the platen bar and other machine elements and serving as an integral machine frame.

Referring now to FIG. 8, which shows the left end elevation of a printer generally designated by the numeral 200 which is also designed to produce imprints with individual character chips as referred to in the description of printer 10 in FIG. 1. To maintain an extremely precise relationship and alignment during imprinting, the printer 200 is fitted with a massive platen bar 212 having a generally flat face in the writing line area. A print carriage 214 is slidably supported on three narrow guide rails: top rail 216, side rail 218, and bottom rail 220 which are retained in a massive carriage support bar 222 which also serves as the mainframe for printer 200. As before, a transparent printing area cover 224 provides part of the radiated noise reduction system for the printer and is hinged, by means not shown, for access to the writing area. As previously described, printer 200 is tilted back about 5° to provide better illumination for the writing line.

The paper input path is indicated by the arrow 226. A piece of paper, such as the record material 25 in FIG. 1, is guided to the printing area by outer guide 228 having a flexible front guide portion 230, and an inner guide 232 as generally described for printer 10 of FIG. 1. As before, a matching pair of feed rollers are used, an inner spring-loaded non-driven roller 234, and a driven feed roller 236, both fitted with O-ring friction elements spaced along their length.

A skew adjustment lever 238 is pivoted on shoulder screw 240 located at the top middle of platen bar 212. Lever 238 acts upon springs 239 which load roller 234 to vary the pressure on the roller from one end to the other and hence effect a small change in the feeding direction of the record material. An eccentric paper thickness adjuster 242 engages notch 244 in left platen support 246 and a similar notch exactly parallel to the writing line in the right platen support. Adjuster 242 is operated by lever 248 to move the platen bar 212 through a limited back-and-forth range of movement. A paper exit guide 250 is affixed to platen bar 212. The paper or record material exit path is indicated by arrow 252.

A carbon type ribbon is generally indicated in the idle or rest position at 254. The carriage 214 laterally retains a font drum which is mounted on a character selection drive shaft 256. Shaft 256 is driven by a stepping motor such as motor 77 which is schematically indicated at 77 in FIG. 2. Such a stepping motor and printer controls are shown in the referenced U.S. Pat. No. 3,892,303. As before, a squeeze printing mechanism, not shown, is operated by rotary actuators 258 and 260. A combined chip injector and ejector actuator 262 operates an injector lever which is on the other side of carriage 214, and an ejector lever 264 which works on a plunger in ejector guide 266.

Carriage 214 is positioned along the guide rails by a stepping motor 268 connected to cable drum, not shown in this figure, and thence by cable 270 connected to carriage 214 on each side thereof. The return path of cable 270 passes through a clearance notch 272 in carriage 214. The carriage positioning system of printer 200 is similar to that of printer 10 in FIG. 2 where a cable 80 attached to carriage 14 passes around a cable driving drum 81 on stepping motor 83. These carriage positioning systems are also shown, with the respective controls, in the referenced U.S. Pat. No. 3,892,303.

Figure 10:
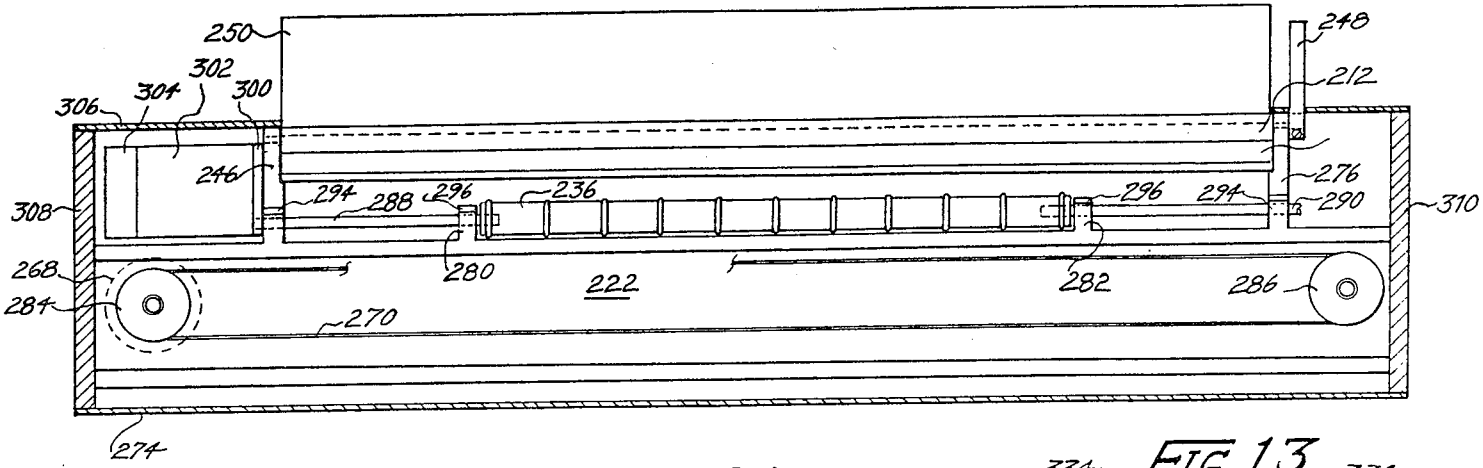
FIG. 10 is a front elevation of the printer of FIG. 6 showing schematic detail of the platen bar, the primary feed roller, the supporting ribs of FIG. 9, the integral frame, several machine elements, and the printer case.

The relative location of the bottom cover of printer 200 is indicated at 274 in FIG. 8 and in FIG. 10 which also shows the top cover 306 and the supporting printer case sidewalls 308 and 310 which, in turn, are fastened to the respective ends of the carriage support bar, preferably by vibration isolators to insulate the printer case from conducted imprinting noise.

Figure 9:
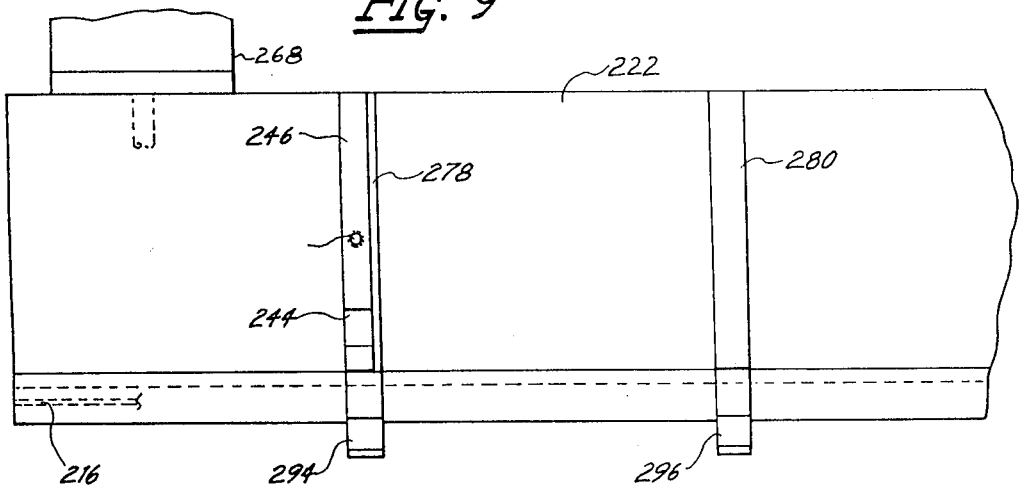
FIG. 9 is a top view of the left third of the integral machine frame and carriage support bar showing the supporting ribs for the platen bar and the primary paper feed roller.

The massive, integrated carriage support bar 222 is shown in additional detail in FIGS. 9 and 10. The left platen support 246 and right platen support 276 are external ribs which are integral parts of the carriage support bar 222. FIG. 9 shows a top view of the left half of support bar 222, and FIG. 10 shows supports 246 and 276 in elevation. Both supports 246 and 276 have a shelf 278 for the platen bar 212 to rest and slide back and forth upon for paper thickness adjustment. In addition to the two transverse ribs or supports 246 and 276, at least two additional integral ribs 280 and 282 are located between supports 246 and 276 to support the outer or driven feed roller 236 and are appropriately curved on their top surfaces to support the fixed outer paper guide 228.

The driven feed roller 236 has a driving shaft 288 and a long shaft 290 for hand operation if needed. Both shafts 288 and 290 have two bearings each. One of these bearings 292 can be seen endwise in FIG. 8. These bearings 292 are retained in notches 294 in left platen support 246 and right platen support 276 and in notches 296 in the paper guide support ribs 280 and 282. The method of bearing retention can be as required by the specific machine design. One such method of retention is shown in FIG. 8 where a bearing 292 is held in a notch 296 by a cross-pin 298. Shaft 288 extends into a gear box 300 attached to left platen support 246. A stepping motor 302 having a commutator 304 is supported in turn on gear box 300 as can be seen in FIG. 10.

FIG. 10 also shows the relative location of a cable drum 284 which is attached to stepping motor 268, and an idler pulley 286 at the other end of the cable loop. Cable 270 has several wraps around cable drum 284 and its two ends fastened to carriage 214 which is not shown in FIG. 10.

The massive carriage support bar 222 is made with a cross-section of sufficient size to resist twist and deflection from the pressure of imprinting as is the platen bar 212. While bar 222 is shown with a longitudinally hollow structure as can be seen in FIG. 8, it could equally well be cast with a plurality of internal transverse ribs forming hollow boxes open to the rear of the printer in so-called egg crate fashion. Bar 222 can also have the control system power transistors mounted thereon and thus serve as an excellent heat sink.

By making the transverse external ribs, the supports 246, 276, 280 and 282, integral with the carriage support bar 222, it is then very practical to machine all critical grooves and notches in one machine set-up. Thus the grooves for the guide rails 216, 218, and 220; the notches 294 and 296 for supporting the driven feed roller 236; and paper thickness adjuster notches 244 can all be made exactly parallel in all pertinent planes. Further, the platen bar 212 supporting shelves 278 can be profiled exactly square with the grooves for the guide rails and thereby eliminate the need for platen tilt adjustment. Still further, if the single set-up is done on a machine of the transfer type, all critical holes can also be drilled with precise reference to all the longitudinal alignment grooves and notches.

With this massive carriage support bar 222 fabricated as suggested, it can also be used to support the printer case sidewalls 308 and 310 which, if the print mechanism is a quiet type, can also be integral with bar 222. When the grooves for rails 216, 218, and 220 are machined, they can be made wider for rail retention as shown in FIG. 3, or can be cut to be used as guide grooves directly as shown in FIG. 6.

Many possible constructions for the carriage support bars 22 or 222 can be used without departing form the invention as set forth herein. For example, if the printing mechanism imparts little pressure to the platen bar, folded and flanged channel sheet metal constructions with integral rails can be used. The inherent guiding accuracy of the print carriage as described herein is also ideal for printers having a dot matrix or ink jet type of printing mechanism. While rectangular cross-sections have been shown and described for the platen bars and carriage support bars, a conventional round, rotating platen bar can be used, and there are other shapes which are practical for the carriage support bars.

While the three narrow guideways are shown as grooves or retained rails, the rails could well be integral with the carriage support structure and project thereform. For example, if the support bar is of an aluminum alloy, the integral rails projecting thereform could be hard anodized for wear resistance. The print carriage could even be equipt with anti-friction bearings to engage the rails or grooves but at a considerable increase in cost for only a small gain in reducing frictional drag. If the rails are made integral with a sheet metal construction as already mentioned, the sheet metal can be cut with alternate, frequently spaced, notches to form tongues which interlock and project when the sheet metal is formed into a tube. Thusly, the resulting "rails" are a series of interrupted projections at right angles to each other to form the two adjacent rails, and the third rail is made up of a series of punched through projections. Alternatively, two pieces of sheet metal can be used and each notched to form the interlocking projections which become "rails."

Figure 11:
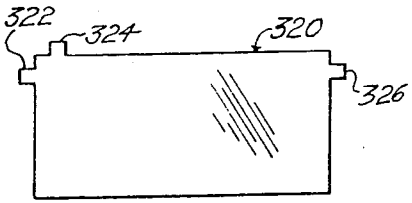
FIG. 11 is an end view of a carriage support bar with integral guideway rails.

FIG. 11 shows a carriage support bar 320 with integral front, top, and back rails 322, 324, and 326 respectively, which can be used with a carriage 14 as shown in FIGS. 1, 2, and 3. While the bar 320 is shown solid, it could be an aluminum alloy extrusion and hollow.

Figure 13:
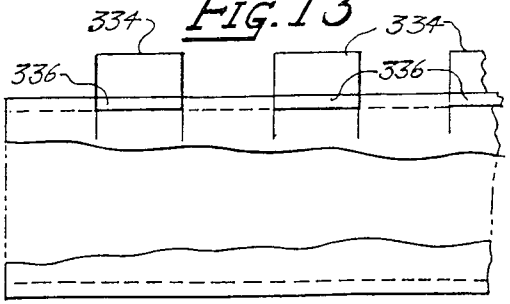
FIG. 13 is a partial side view of the sheet metal bar of FIG. 12 and shows how the notched and punched out projections are arranged.
Figure 12:
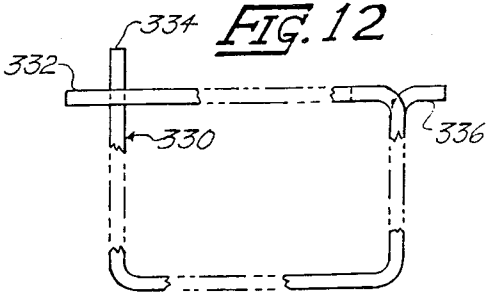
FIG. 12 is an end view of a carriage support bar formed of sheet metal with integral rails.

A sheet metal carriage support bar 330 is shown in FIGS. 12 and 13. The alternating extensions 336 are punched out and bent over before the top of the hollow rectangle is formed. The strip of sheet metal is notched to form the front and top rail alternating extensions 332 and 334 before any forming is done. A bead of solder can be run along where the notches come together between extensions 332 and 334 to secure additional rigidity . A sheet metal support bar is quite suited for an ink jet or other matrix printer to reduce costs and weight.

I claim:

1. A printer comprising:

a stationary elongated platen, a print carriage movable with reference to said platen and having printing means for producing printing along a writing line, positioning means, comprising a motor having a rotary output shaft and connecting means driven by said shaft which converts the rotary motion to linear motion for positioning the carriage along the writing line, a rigid elongated bar extending parallel to said platen; said print carriage and said positioning means being supported by, and substantially their entire weight being carried by, said bar, a plurality of guideways disposed along said bar for guiding said carriage along a precise path parallel to said platen, said guideways being narrow with respect to the thickness of the bar, said guideways including means cooperating with said print carriage to limit the print carriage to movement that is parallel to said writing line, and reciprocal guiding means on said carriage for engaging said guideways and cooperating therewith to guide said carriage.

2. In a printer as defined in claim 1:

said plurality of guideways comprising (a) first and second guideways lying in mutually orthogonal planes, (b) a third guideway in essentially one of said orthogonal planes, said first and second guideways being relatively closely spaced from one another as compared to the spacing of the third guideway from the other two.

3. A printer as defined in claim 2 in which said rigid bar supports said platen and holds it in a predetermined position relative to said bar.

4. A printer as defined in claim 2 in which said positioning means for said carriage comprises a cable attached to each end of said carriage as closely as practical to said first and third guideways.

5. A printer as defined in claim 2 in which said guideways are thin rails generally less than 0.06 inches (1.5 mm) thick projecting from said bar, said bar has grooves for retaining said rails, and said reciprocal guiding means comprise grooves.

6. A printer as defined in claim 2 in which said guideways comprise rails projecting from the surface of said bar and are integral therewith, and said reciprocal guiding means comprise grooves in a material slidably compatible with said carriage.

7. A printer as defined in claim 2 in which said guideways comprise grooves in said bar, each groove being generally less than 0.06 inches (1.5 mm) wide, and said reciprocal guiding means comprise sliding shoes attached to said carriage.

8. A printer as defined in claim 2 in which said bar is positioned generally in front of said writing line and has means extending from the ends thereof for supporting and retaining said platen and said means for positioning, feeding, and guiding, said bar thus comprising said frame.

9. A printer as defined in claim 2 in which said bar is positioned generally below said platen and has integral transverse members extending upward therefrom for supporting said platen and holding said platen in a predetermined position with respect to said bar.

10. A printer as defined in claim 2 in which said reciprocal guiding means engage said first and third guideways for a substantial distance therealong and said second guideway for a much shorter distance.

11. A printer as defined in claim 6 in which said bar comprises a tube-like structure formed from sheet metal, and said integral rails each comprise a plurality of alternating projections from said structure.

12. A printer having:

a frame, a print carriage movable with respect to said frame and including means for producing printing along a writing line on record material, a stationary platen structure for supporting the record material to receive printing, means, comprising a motor, for positioning the carriage along the writing line, first and second cooperating feed rollers for feeding the record material therebetween, means for biasing the first feed roller into engagement with the second feed roller, driving means connected to the second feed roller, inner and outer infeed guides for guiding and supporting the record material therebetween and along a path from the region in back of the platen structure to the feed rollers and thence to the writing line, a single carriage support bar positioned below and parallel to said platen structure, said bar constituting the sole support for said motor and said print carriage, first, second, and third guideways disposed along said bar for guiding said carriage along a precise path, said guideways being narrow with respect to the width of the bar, said guideways including means cooperating with said print carriage to limit the print carriage to movement that is parallel to said writing line, reciprocal guiding means on said carriage for slidably engaging said guideways, means associated with said platen structure for supporting and retaining said first feed roller, said biasing means, and said inner infeed guide, and means extending upward from said bar and integral therewith for supporting and retaining said platen structure, said second feed roller, said driving means, and said second infeed guide.

13. A printer as defined in claim 12 in which said first guideway has two closely spaced parallel guiding surfaces lying on each side of a first plane, said second guideway has two closely spaced parallel guiding surfaces lying on each side of a second plane which is parallel to said first plane, said second guideway is spaced from said first guideway by approximately the width of said bar, said third guideway has two closely spaced parallel guiding surfaces lying on each side of a third plane which is essentially orthogonal to said first and second planes, and said first and third guideways are spaced in close proximity to each other.

14. A printer as defined in claim 13 in which said positioning means for said carriage comprise a cable attached to each end of said carriage as closely as practical between said first and third guideways.

15. A printer as defined in claim 12 in which said stationary platen structure is a rigid bar, and said first feed roller and said inner infeed guide are supported by said stationary platen structure.

16. A printer comprising:

a stationary elongated platen, a print carriage movable with reference to said platen and having printing means for producing printing along a writing line, positioning means for positioning the carriage along the writing line, a rigid bar positioned parallel to said platen and constituting the sole support for said print carriage, first, second, and third guideways disposed along said bar for guiding said carriage along a precise path, said guideways being narrow with respect to the thickness of the bar, said guideways including means cooperating with said print carriage to limit the print carriage to movement that is parallel to said writing line, reciprocal guiding means on said carriage for engaging said guideways, said first guideway having two closely spaced parallel guiding surfaces lying on each side of a first plane, said second guideway having two closely spaced parallel guiding surfaces lying on each side of a second plane and substantially coincident therewith, said second guideway being spaced from said first guideway by approximately the thickness of said bar, and said third guideway having two closely spaced parallel guiding surfaces lying on each side of a third plane which is essentially orthogonal to said first and second planes, said third guideway being spaced much closer to the first guideway than it is to the second guideway, said positioning means including cable means connected to said carriage.

* * * * *